US007959586B2

(12) United States Patent
Kondo

(10) Patent No.: US 7,959,586 B2
(45) Date of Patent: Jun. 14, 2011

(54) MULTIFUNCTION EQUIPMENT

(75) Inventor: Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 1245 days.

(21) Appl. No.: 11/422,786

(22) Filed: Jun. 7, 2006

(65) Prior Publication Data

US 2006/0282024 A1 Dec. 14, 2006

(30) Foreign Application Priority Data

Jun. 10, 2005 (JP) ..... P2005-171681

(51) Int. Cl.
*A61H 1/00* (2006.01)

(52) U.S. Cl. ..... 601/15; 601/23; 601/24

(58) Field of Classification Search ..... 601/15, 601/23, 24, 154; 5/613, 617; 482/8, 9, 148
See application file for complete search history.

(56) References Cited

U.S. PATENT DOCUMENTS 6,066,087 A * 5/2000 Tron ..... 601/23
7,028,355 B2 * 4/2006 Koga ..... 5/606

FOREIGN PATENT DOCUMENTS

| | | |
|---|---|---|
| JP | HEI 03-013167 | 2/1991 |
| JP | HEI 04-212388 | 8/1992 |
| JP | HEI 07-163677 | 6/1995 |
| JP | 7-248183 | 9/1995 |
| JP | 2000-214755 | 8/2000 |

OTHER PUBLICATIONS

Japanese Office Action issued on Jul. 13, 2010 corresponding to Japanese Patent Appln. No. 2005-171681.

* cited by examiner

*Primary Examiner* — Quang D Thanh
(74) *Attorney, Agent, or Firm* — K&L Gates LLP

(57) ABSTRACT

Multifunction equipment installed in a room is provided. The multifunction equipment has main body and movable device that moves to implement plural functions, thereby allowing the multifunction equipment to be used as plural functional devices. The movable device is connected to the main body. The multifunction equipment also has assisting device that assists a use of the multifunction equipment as a desired functional device when the movable device moves to allow the multifunction equipment to be used as the desired functional device.

6 Claims, 13 Drawing Sheets

ST81
START
ST82
HAS USER ENTERED DATA ?
NO
YES
ST83
HAS USER ENTERED A PREDETERMINED PERIOD OF TIME ?
NO
YES
ST87
CARRY OUT THE PROCESS CORRESPONDING TO ANY USER ENTRY
ST84
HAS USER ENTERED THE PREDETERMINED PERIOD OF TIME CORRESPONDING TO EACH OF THE STEPS ?
NO
YES
ST85
AVERAGE ALL THE ENTERED PERIODS OF TIME
ST86
MAINTAIN AVERAGE AS A SET VALUE
END

MULTIFUNCTION EQUIPMENT

CROSS REFERENCE TO RELATED APPLICATION

The present invention contains subject matter related to Japanese Patent Applications No. JP 2005-171681 filed in the Japanese Patent Office on Jun. 10, 2005, the entire contents of which being incorporated herein by reference.

BACKGROUND

The present invention relates to multifunction equipment. More particularly, it relates to equipment used as a bed and a fitness machine, and a chair for audience (an audience seat).

A bath room can be used as a drying room. In this moment, the bath room is used as the drying room only when the bath room is not used as the bath room (see Japanese Patent Application Publication No. H07-248183).

A chair for audience (an audience seat) can be moved in a theater with it matching any motion in an image (see Japanese Application Publication No. 2000-214755). In this case, the chair is moved based on a motion control signal that is generated according to motion vector detected from an image signal. This allows an audience to feel as if he or she were there.

In the above room, there would be the bath room and the drying room separately in terms of time. According to such the room, the bath room has its sole effect and the drying room has its sole effect, which are separated from each other. Thus, any one of the effects by bath room and the drying room can be selectively acquired by the room.

In the chair for audience (an audience seat), the audience can feel tired in accordance with an intensity of movement of the chair, if too strong, and the duration thereof.

SUMMARY

It is desirable to provide multifunction equipment that is preferably available in the room. It is also desirable to provide multifunction equipment that is possible to give human body any pressure effect successfully.

According to an embodiment of the invention, there is provided first multifunction equipment that is installed in a room. The first equipment has main body and movable device that moves to implement plural functions, thereby allowing the multifunction equipment to be used as plural functional devices. The movable device is connected to the main body. The first equipment also has assisting device that assists a use of the multifunction equipment as a desired functional device when the movable device moves to allow the multifunction equipment to be used as the desired functional device.

In this embodiment of the first multifunction equipment according to the invention, the multifunction equipment is installed in a room. The movable device, which is connected to the main body, moves to implement plural functions, thereby allowing the multifunction equipment to be used as plural functional devices. When the first multifunction equipment is used as a desired functional device, the assisting device assists a use of the multifunction equipment as the desired functional device. For example, when the first multifunction equipment is equipment used as a bed and a fitness machine, this equipment is used as the bed or the fitness machine. If it is used as the fitness machine, the assisting device assists a use of the multifunction equipment as the fitness machine by a shower device and/or a cooler device. If it is used as the bed, the assisting device assists a use of the multifunction equipment as the bed by an air-conditioning device.

Thus, since the assisting device assists a use of the first multifunction equipment when the first multifunction equipment is used as the desired functional device, the first multifunction equipment is preferably available in the room as the desired functional device. For example, the first multifunction equipment can detect a condition of a user who uses the first multifunction equipment and control its function to change the function automatically based on a detected result thereof. This enables any change of function by the user to be saved.

Further, the first multifunction equipment can detect a condition in the room and adjust an assisting condition by the assisting device based on a detected result thereof. This enables a use of the first multifunction equipment as a desired functional device to be made much comfortable.

According to another embodiment of the invention, there is provided second multifunction equipment. The second multifunction equipment has feature-extracting device that extracts a feature from a contents-playback signal. The second multifunction equipment also has first pressuring device that pressures a predetermined position of a region, which contacts human body, of the second multifunction equipment. The second multifunction equipment further has second pressuring device that pressures a selected region of the region contacting the human body. The second multifunction equipment additionally has control-signal-generating device that generates a control signal, which controls the first pressuring device and the second pressuring device based on the feature extracted by the feature-extracting device. Both of the first pressuring device and the second pressuring device are driven within a predetermined period of time.

In this embodiment of the second multifunction equipment according to the invention, a feature is extracted from a contents-playback signal. The feature is extracted as an amount of a motion control signal that is generated based on motion vector detected from an image signal included in the contents-playback signal. The feature can be extracted as a total amount of the contents-playback time.

The first pressuring device pressures a predetermined position of a region, which contacts human body, of the second multifunction equipment, thereby giving the human body any massage effects, for example. The second pressuring device pressures a selected region of the region contacting the human body, thereby giving the human body any movements for improving his or her feeling as if he or she were there. The control signal, which controls the first pressuring device and the second pressuring device, is generated based on the feature extracted from the contents-playback signal.

According to the embodiment of the second multifunction equipment, any massage effects and any feeling as if audience were there are given his or her human body according to the extracted feature. Thus, such the second multifunction equipment can give the human body not only any feeling as if he or she were there but also any massage effects so that the massage effects can help to recover the tired human body by the movements. The human body thus recovered can further feel as if he or she were there much excitedly by the movements.

For example, a living body signal is acquired from human body, and then, the embodiment of the second multifunction equipment can generate the control signal for controlling at least the first pressuring device based on the feature extracted from the contents-playback signal as described above and the living body signal. This enables the human body to be given any massage effect that is much preferably suitable for the human body.

Further, an amount of control signal for controlling at least the first pressuring device can be controlled based on information entered by the external entry device. This enables a user to adjust the massage effect and/or the movements of the second multifunction equipment easily to one that is comfortable in the user.

Additionally, the second multifunction equipment constitutes a room and has, for example, a chair or seat shape. The second multifunction equipment can have third pressuring device that changes the shape of this multifunction equipment. The third pressuring device can change the shape of the second multifunction equipment based on the living body signal acquired from the human body. In an embodiment of the second multifunction equipment, an angle of a backrest of a chair can be automatically changed. This enables any change of the angle of the backrest by the user to be saved.

The concluding portion of this specification particularly points out and directly claims the subject matter of the present invention. However that skill in the art will best understand both the organization and method of operation of the invention, together with further advantages and objects thereof, by reading the remaining portions of the specification in view of the accompanying drawing(s) wherein like reference characters refer to like elements.

Additional features and advantages are described herein, and will be apparent from, the following Detailed Description and the figures.

DETAILED DESCRIPTION

Figure 1:
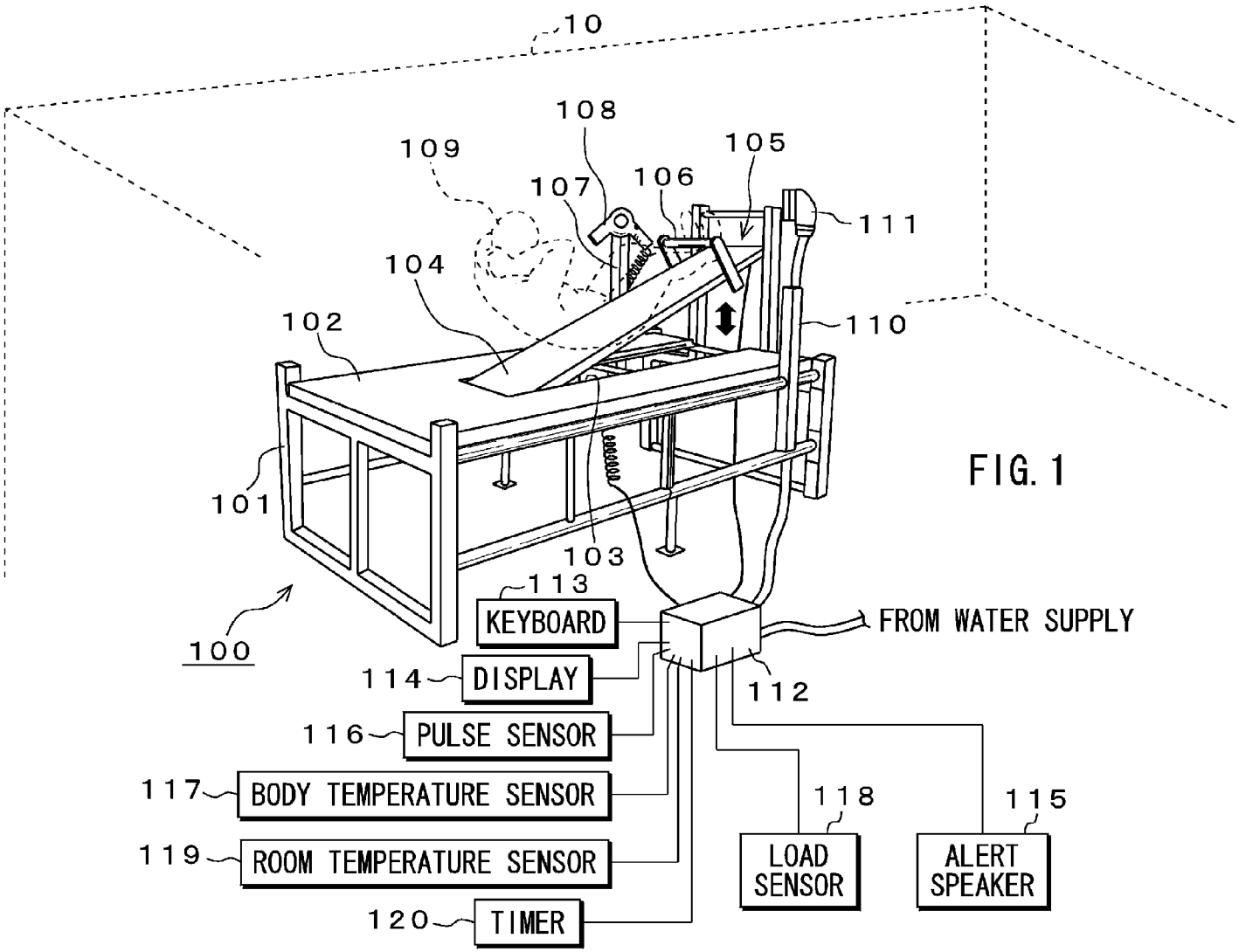
FIG. 1 is a block diagram for illustrating a configuration of equipment used as a bed and a fitness machine according to a first embodiment of the invention.

Referring now to the drawings, multifunction equipment according to preferred embodiments of the invention will be described specifically below.

FIG. 1 illustrates a configuration of equipment 100 used as a bed and a fitness machine according to a first embodiment of the invention. The equipment 100 used as a bed and a fitness machine is installed in a room 10 as an example of the multifunction equipment.

A base 101 mounts a mattress-supporting plate 102. The mattress-supporting plate 102 has a rectangular space 103 that extends longitudinally from an edge thereof to a middle portion thereof. A rectangular board 104 for abdominal muscle training exercise is fit into the rectangular space 103 with the rectangular board 104 pivoting by supporting an end thereof by cut portion of the mattress-supporting plate 102 corresponding to the middle thereof. The other end of the rectangular board 104 can move up and down by using a lifting-and-lowering mechanism 105 attached to the base 101. Thus, moving the other end of the rectangular board 104 up and down by using the lifting-and-lowering mechanism 105 enables an inclined angle of the rectangular board 104 to be adjusted. It is to be noted that the mattress-supporting plate 102 and the rectangular board 104 have such a structure that water can go through it or are water-repellent. A water-reservoir and a drain, which are not shown, are provided under and around the mattress-supporting plate 102 and the rectangular board 104. It is also to be noted that a sit-up bar 106 for keeping user's foot in place while doing sit-up is attached to the other end of the rectangular board 104.

An air-conditioning device 108 is attached to a supporting rod 107 of the base 101. The air-conditioning device 108 is attached to a position and an angle so that it can blow cool air toward a user 109 who excises the sit-up on the rectangular board 104.

A shower nozzle 111 is attached to another supporting rod 110 of the base 101. The shower nozzle 111 is attached to a position and an angle so that it can shower water toward the user 109 who excises the sit-up on the rectangular board 104.

A control device 112 controls the lifting-and-lowering mechanism 105, the air-conditioning device 108, and the shower nozzle 111. The shower nozzle 111 receives water having a preset temperature from a water supply, which is not shown, through the control device 112. The control device 112 is connected to a keyboard 113 for user entry, a display 114, an alert speaker 115, a pulse sensor 116, a body temperature sensor 117, a load sensor 118, a room temperature sensor 119, and a timer 120.

The pulse sensor 116 and the body temperature sensor 117 constitute user-condition-detecting device. The pulse sensor 116 and the body temperature sensor 117 are attached to any suitable portions of the user 109, thereby detecting his or her pulse and body temperature. They transmit the detection signals therefor to the control device 112. The room temperature sensor 119 constitutes room-condition-detecting device for detecting any condition in the room 10. The room temperature sensor 119 is positioned at a suitable position in the room 10, thereby detecting its room temperature. It transmits the detection signal therefor to the control device 112. The load sensor 118 detects a load applied to the rectangular board 104. It transmits the detection signal therefor to the control device 112. The control device 112 determines whether the user 109 gets on the rectangular board 104 based on the detection signal received from the load sensor 118.

Although the keyboard 113, the display 114, the alert speaker 115, and the timer 120 are shown in FIG. 1 so that they stay away from the control device 112, the keyboard 113, the display 114, and the alert speaker 115 can be integrally attached to a case of the control device 112 and the timer 120 can be incorporated into the case of the control device 112.

Figure 2:
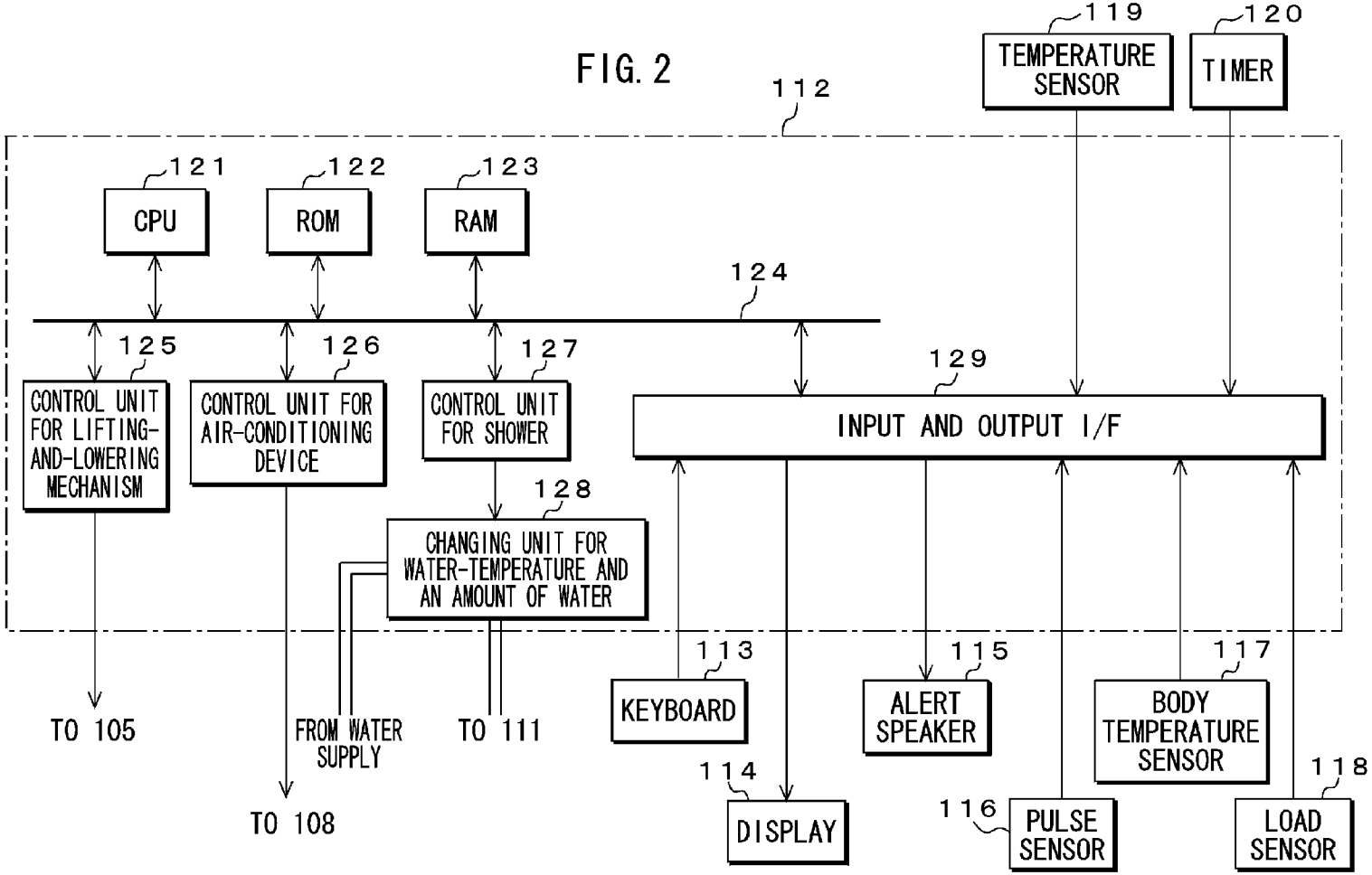
FIG. 2 is a block diagram for showing a configuration of a control device in the equipment used as a bed and a fitness machine shown in FIG. 1.

FIG. 2 shows a configuration of the control device 112. The control device 112 has a central processing unit (CPU) 121, a read only memory (ROM) 122, and a random access memory (RAM) 123, which are connected to a bus 124. The CPU 121 controls entire software and hardware. The ROM 122 stores control program for controlling operations of the CPU 121. The RAM 123 is designed to function as a working area for the CPU 121.

The control device 112 also has a control unit 125 for the lifting-and-lowering mechanism, a control unit 126 for the air-conditioning device, a control unit 127 for the shower, and a changing unit 128 for water-temperature and an amount of water. These control units 125, 126, 127 are connected to the bus 124.

The control unit 125 controls lifting-and-lowering operations of the lifting-and-lowering mechanism 105 (see FIG. 1) under the control of the CPU121. The control unit 126 controls air-conditioning operations of the air-conditioning device 108 (see FIG. 1) under the control of the CPU121. The control unit 127 controls operations of the changing unit 128 for water-temperature and an amount of water under the control of the CPU 121. When using the shower, the changing unit 128 adjusts the temperature and the amount of water received from the water supply to preset values thereof and supplies the adjusted water to the shower nozzle 111 (see FIG. 1).

The control device 112 further has an input/output interface (I/O interface) 129. The I/O interface 129 is connected to the bus 124. The I/O interface 129 is also connected to the keyboard 113, the display 114, the alert speaker 115, the pulse sensor 116, the body temperature sensor 117, the load sensor 118, the room temperature sensor 119, and the timer 120. The timer 120 can be built in the control device 112.

Figure 3:
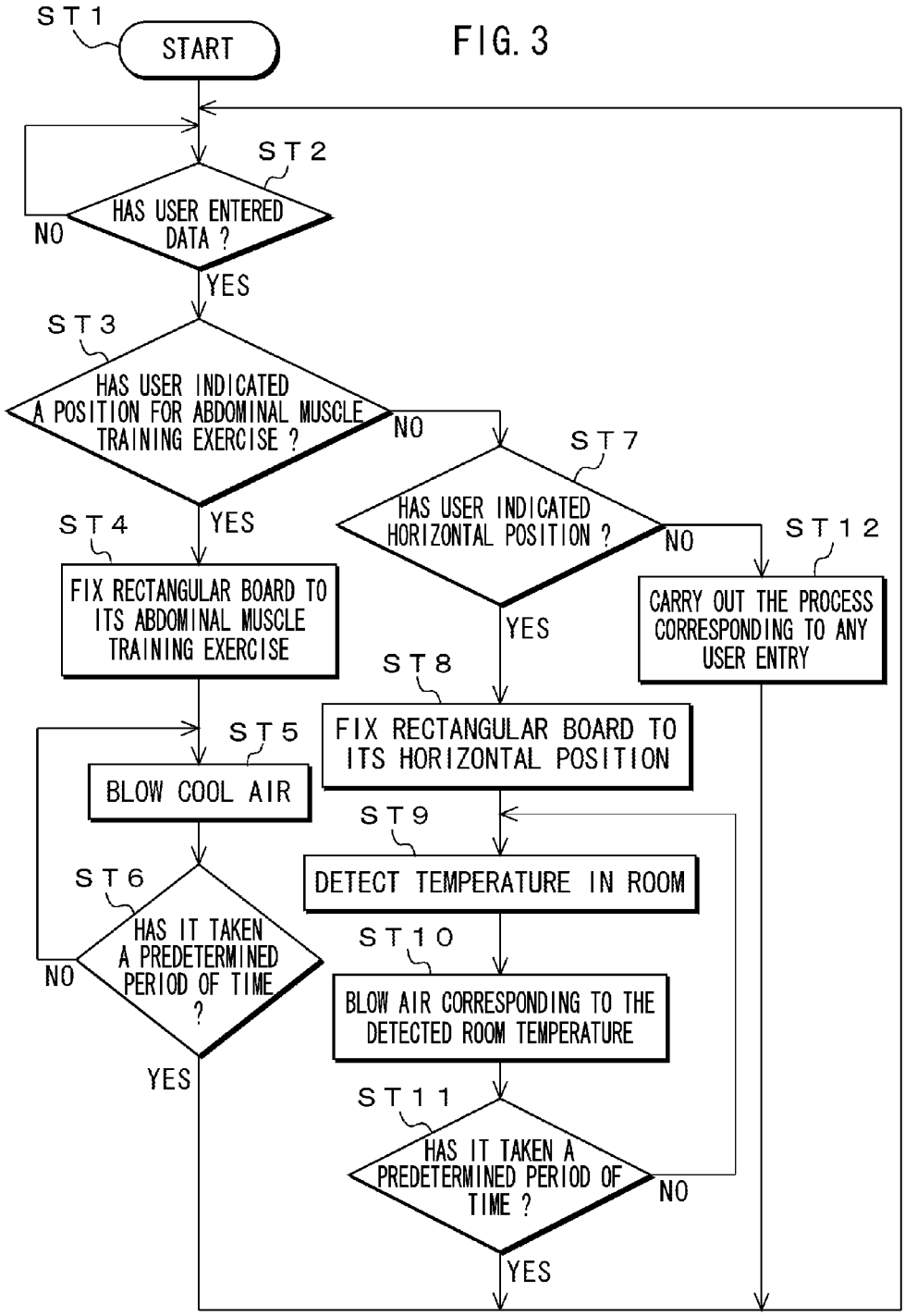
FIG. 3 is a flowchart for showing a control example by the control device shown in FIG. 2.

The following will describe a control example of the control device 112 (CPU 121) in the equipment 100 used as a bed and a fitness machine, as shown in FIG. 1, with reference to a flowchart shown in FIG. 3.

At step ST1, the control operation process thereof starts if, for example, the power is on. At step ST2, the control device 112 determines whether a user enters data by using the keyboard 113. If he or she enters the data, the process goes to step ST3 where the control device 112 determines whether the user indicates a position of the rectangular board 104 for the abdominal muscle training exercise. If he or she indicates the position thereof for the abdominal muscle training exercise, the process goes to step ST4 where the control device 112 controls the lifting-and-lowering mechanism 105 to fix the rectangular board 104 to its position for the abdominal muscle training exercise (see the position of the rectangular board 104 shown in FIG. 1).

At step ST5, the control device 112 controls the air-conditioning device 108 to blow cool air. At step ST6, the control device 112 determines whether it has taken a predetermined period of time. If it has not yet taken the predetermined period of time, the process goes back to the step ST5 where the air-conditioning device 108 continues to blow the cool air. If it has already taken the predetermined period of time at the step ST6, the process goes back to the step ST2 where the process waits next user entry. In this duration, the control device 112 controls the air-conditioning device 108 to stop blowing the cool air.

If the user indicates no position of the rectangular board 104 for the abdominal muscle training exercise at the step ST3, the process goes to step ST7 where the control device 112 determines whether the user indicates a horizontal position of the rectangular board 104. If he or she indicates the horizontal position of the rectangular board 104, the process goes to step ST8 where the control device 112 controls the lifting-and-lowering mechanism 105 to fix the rectangular board 104 to its horizontal position. At this horizontal position, the rectangular board 104 is fit into the rectangular space 103 of the mattress-supporting plate 102 with the rectangular board 104 becoming flat-surface with the mattress-supporting plate 102.

At step ST9, temperature in the room 10 is detected based on the detection signal of the room temperature sensor 119. At step ST10, the control device 112 controls the air-conditioning device 108 to blow air corresponding to the detected room temperature.

At step ST11, the control device 112 determines whether it has taken a predetermined period of time, for example, six hour. If it has not yet taken the predetermined period of time, the process goes back to the step ST9 where the air-conditioning device 108 continues to blow the air corresponding to the detected room temperature. If it has already taken the predetermined period of time, the process goes back to the step ST2 where the process waits next user entry. In this duration, the control device 112 controls the air-conditioning device 108 to stop blowing the air.

If the user indicates no horizontal position of the rectangular board 104 at the step ST7, the process goes to step ST12 where the process corresponding to any user entry is carried out and the process then goes back to the step ST2 where the process waits next user entry.

According to this control operation, the rectangular board 104 is fixed at its position for the abdominal muscle training exercise so that the equipment 100 can be used as a fitness machine. In this moment, the air-conditioning (cooler) device 108 as assisting device blows the cool air toward the user 109 to fall his or her body temperature down. This enables the user 109 to use the equipment 100 as the fitness machine much comfortably.

Further, the rectangular board 104 is fixed at its horizontal position so that the equipment 100 can be used as a bed. In this moment, the air-conditioning device 108 as assisting device blows the air corresponding to the temperature of the room 10 toward the user 109. This enables the user 109 to sleep much comfortably, thereby allowing the user 109 to use the equipment 100 as the bed much comfortably.

Figure 4:
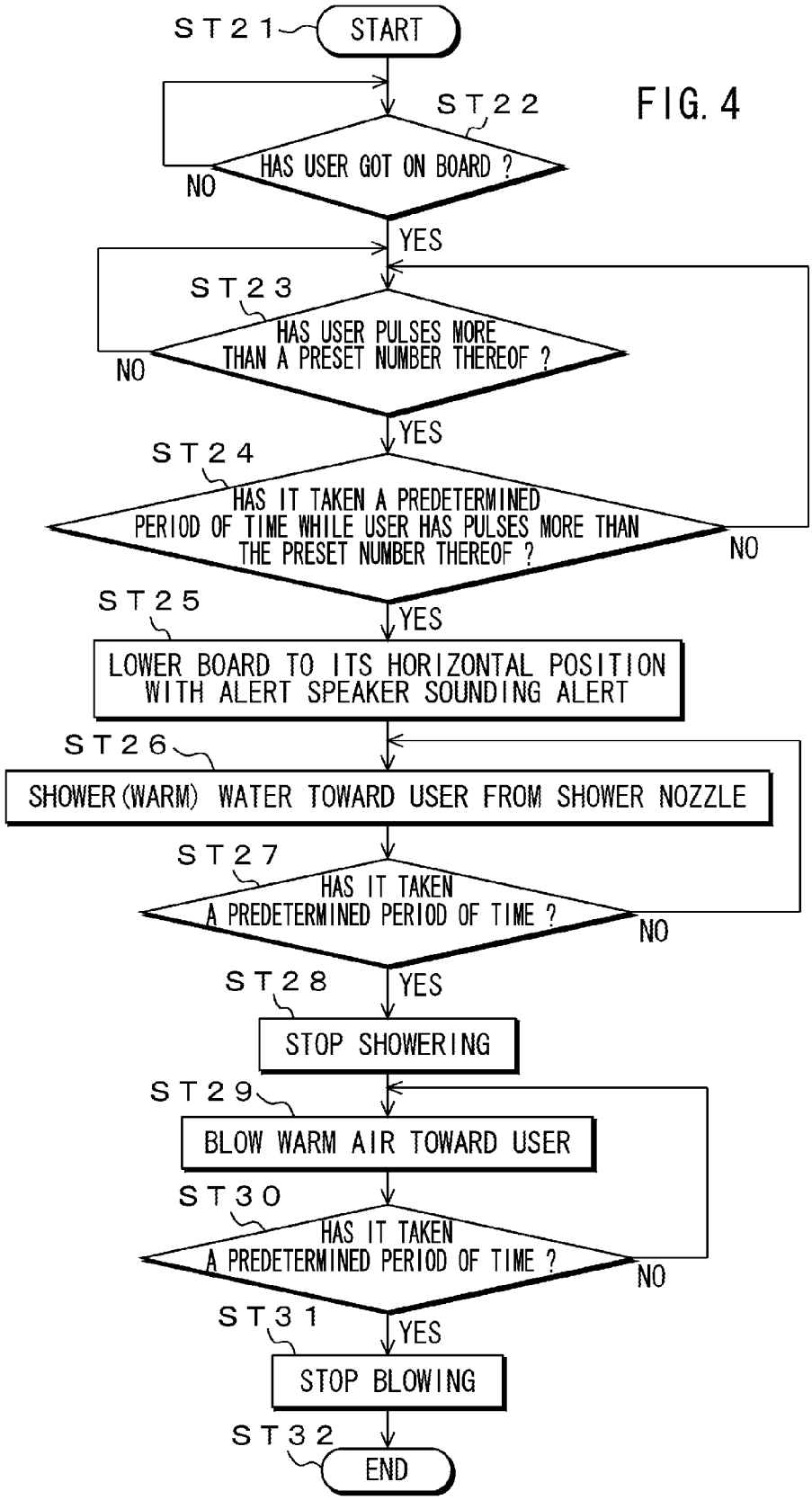
FIG. 4 is a flowchart for showing a control example by the control device shown in FIG. 2.

Next, the following will describe another control example of the control device 112 (CPU 121) in the equipment 100 used as a bed and a fitness machine, as shown in FIG. 1, with reference to a flowchart shown in FIG. 4.

At step ST21, the control operation process thereof starts if, for example, the rectangular board 104 is fixed at its position for the abdominal muscle training exercise. At step ST22, the control device 112 determines whether the user 109 gets on the rectangular board 104 based on the detection signal received from the load sensor 118. If he or she gets on the rectangular board 104, the process goes to step ST23 where the control device 112 determines whether the user 109 has pulses more than a preset number thereof, for example, 100 pulses/minute, based on the detection signal received from the pulse sensor 116. At step ST24, the control device 112 determines whether it has taken a predetermined period of time, for example, five minutes, while the user 109 has pulses more than the preset number thereof. If it has already taken the predetermined period of time, the process goes to step ST25.

At the step ST25, the control device 112 controls the lifting-and-lowering mechanism 105 to lower the rectangular board 104 to its horizontal position with the alert speaker 115 sounding an alert. At step ST26, the control device 112 controls the changing unit 128 for water-temperature and an amount of water through the control unit 127 for the shower to shower (warm) water having preset temperature toward the user 109 from the shower nozzle 111. At step ST27, the control device 112 determines whether it has taken a predetermined period of time, for example, ten minutes. If it has not yet taken the predetermined period of time, the process goes back to the step ST26 where the (warm) water from the shower nozzle 111 is continuously showered toward the user 109. This enables the user 109 to get rid of the sweat occurring at the abdominal muscle training exercise. It is to be noted that the water is gathered into the water-reservoir and drains outside the room through the drain. If it has already taken the predetermined period of time, the control device 112 stops showering at step ST28 and the process then goes to step ST29.

At the step 29, the control device 112 controls the air-conditioning device 108 to blow warm air toward the user 109. At step ST30, the control device 112 determines whether it has taken a predetermined period of time, for example, six hours. If it has not yet taken the predetermined period of time, the process goes back to the step ST29 where the air-conditioning device 108 continues to blow the warm air. This enables the user to dry his or her body by air bedding, thereby putting him or her to comfortable sleep. If it has already taken the predetermined period of time at the step ST30, the process goes back to the step ST31 where the control device 112 controls the air-conditioning device 108 to stop blowing the warm air. At step ST32, the process then stops.

According to this control operation, the rectangular board 104 is automatically lowered from its position for the abdominal muscle training exercise to its horizontal position when it has taken a predetermined period of time while the user 109 who exercises his or her abdominal muscle training on the rectangular board 104 has pulses more than a preset number thereof after the equipment 100 has been used as a fitness machine. In this moment, the equipment 100 can be used as a bed. This enables the user 109 to found a point of time when he or she stops exercising his or her abdominal muscle training. Further, this allows any operations of the user who lowers the rectangular board 104 from its position for the abdominal muscle training exercise to its horizontal position to be saved.

Further, the rectangular board 104 is lowered from its position for the abdominal muscle training exercise to its horizontal position so that the equipment 100 can be used as a bed. In this moment, the water having preset temperature is showered to the user 109 for a predetermined period of time and the warm air is then blown to the user 109 for a predetermined period of time. This enables the user 109 to get rid of the sweat by the shower after stopping the abdominal muscle training exercise and then, to dry his or her body by the warm air, thereby allowing the user 109 to sleep much comfortably under a clean environment.

Figure 5:
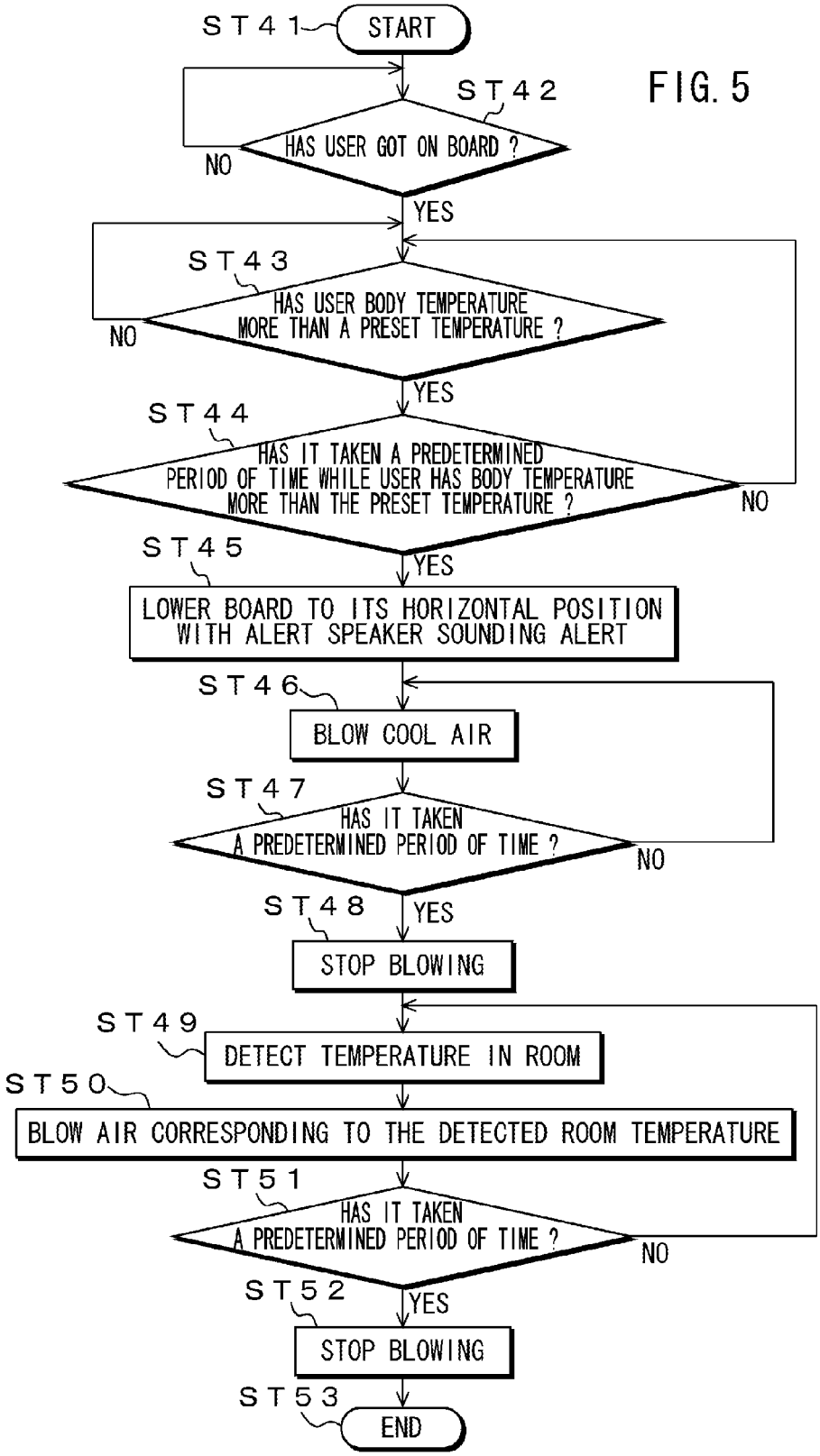
FIG. 5 is a flowchart for showing a control example by the control device shown in FIG. 2.

Next, the following will describe further control example of the control device 112 (CPU 121) in the equipment 100 used as a bed and a fitness machine, as shown in FIG. 1, with reference to a flowchart shown in FIG. 5.

At step ST41, the control operation process thereof starts if, for example, the rectangular board 104 is fixed at its position for the abdominal muscle training exercise. At step ST42, the control device 112 determines whether the user 109 gets on the rectangular board 104 based on the detection signal received from the load sensor 118. If he or she gets on the rectangular board 104, the process goes to step ST43 where the control device 112 determines whether the user 109 has body temperature more than a preset temperature thereof, for example, 38 degrees C. (100.4 degree F.), based on the detection signal received from the body temperature sensor 117. At step ST44, the control device 112 determines whether it has taken a predetermined period of time, for example, five minutes, while the user 109 has body temperature more than the preset temperature thereof. If it has already taken the predetermined period of time, the process goes to step ST45.

At the step ST45, the control device 112 controls the lifting-and-lowering mechanism 105 to lower the rectangular board 104 to its horizontal position with the alert speaker 115 sounding an alert. At step ST46, the control device 112 controls the air-conditioning device 108 to blow cool air toward the user 109. At step ST47, the control device 112 determines whether it has taken a predetermined period of time, for example, ten minutes. If it has not yet taken the predetermined period of time, the process goes back to the step ST46 where the air-conditioning device 108 continues to blow the cool air toward the user 109. This prevents the user 109 from sweating even after the abdominal muscle training exercise. If it has already taken the predetermined period of time, the control device 112 stops blowing the cool air at step ST48 and the process then goes to step ST49.

At the step 49, temperature of the room 10 is detected based on a detection signal of the room temperature sensor 119. At step ST50, the control device 112 controls the air-conditioning device 108 to blow the air having temperature corresponding to the detected room temperature. At step ST51, the control device 112 determines whether it has taken a predetermined period of time, for example, six hours. If it has not yet taken the predetermined period of time, the process goes back to the step ST49 where the air-conditioning device 108 continues to blow the air having temperature corresponding to the room temperature thereof. This enables the user to sleep comfortably. If it has already taken the predetermined period of time at the step ST51, the process goes to the step ST52 where the control device 112 controls the air-conditioning device 108 to stops blowing the air. At step ST32, the process then stops.

According to this control operation, the rectangular board 104 is automatically lowered from its position for the abdominal muscle training exercise to its horizontal position when it has taken a predetermined period of time while the user 109 who exercises his or her abdominal muscle training on the rectangular board 104 has a preset body temperature thereof after the equipment 100 has been used as a fitness machine. In this moment, the equipment 100 can be used as a bed. This enables the user 109 to found a point of time when he or she stops exercising his or her abdominal muscle training. Further, this allows any operations of the user who lowers the rectangular board 104 from its position for the abdominal muscle training exercise to its horizontal position to be saved.

Further, the rectangular board 104 is lowered from its position for the abdominal muscle training exercise to its horizontal position so that the equipment 100 can be used as a bed. In this moment, the cool air is blown to the user 109 for a predetermined period of time. This prevents the user 109 from sweating. The air having temperature corresponding to the room temperature is then blown to the user 109 for a predetermined period of time. This also prevents the user 109 from seating after the abdominal muscle training exercise, thereby allowing the user 109 to sleep much comfortably under a clean environment.

Figure 6:
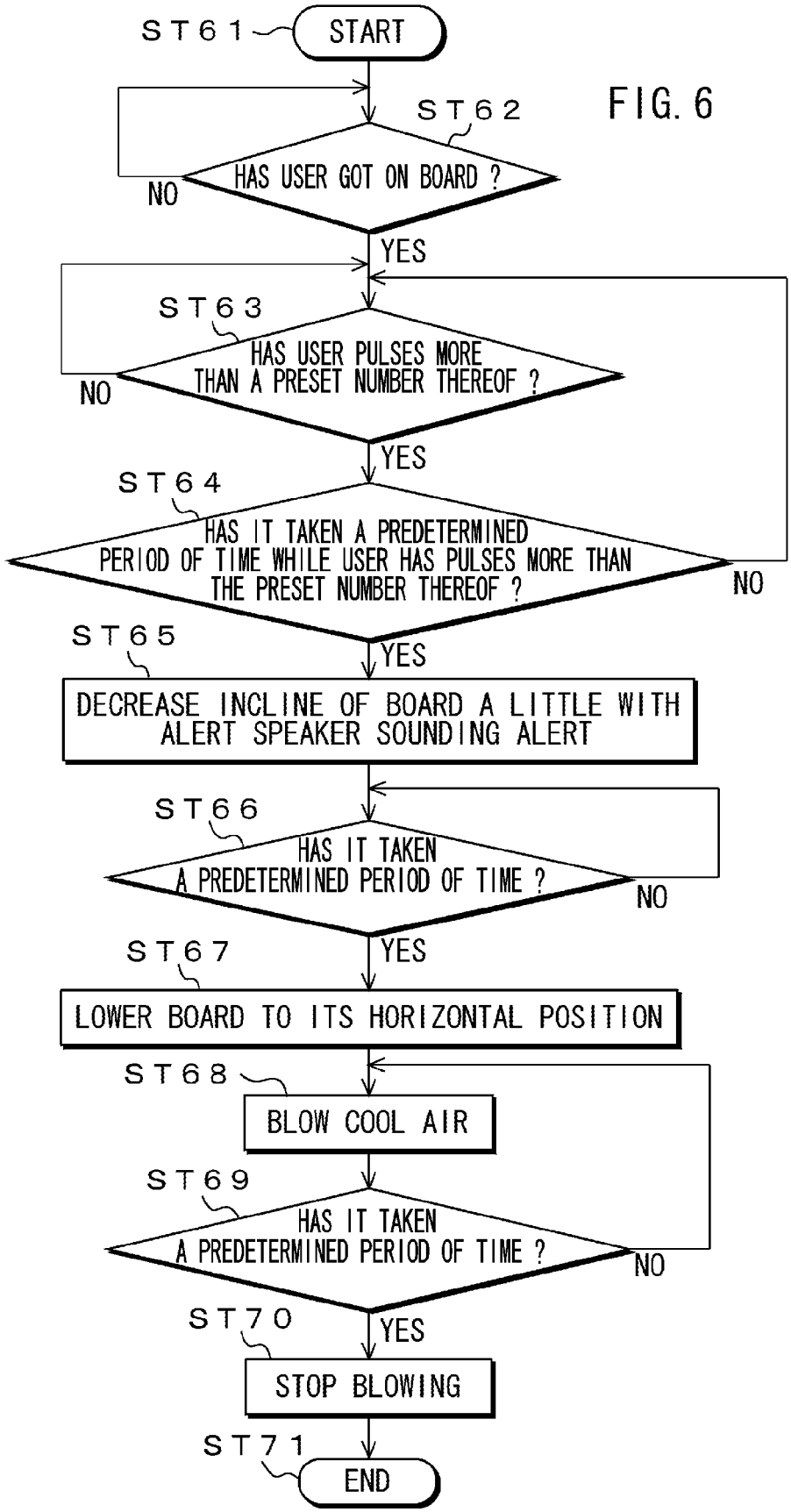
FIG. 6 is a flowchart for showing a control example by the control device shown in FIG. 2.

Next, the following will describe additional control example of the control device 112 (CPU 121) in the equipment 100 used as a bed and a fitness machine, as shown in FIG. 1, with reference to a flowchart shown in FIG. 6.

At step ST61, the control operation process thereof starts if, for example, the rectangular board 104 is fixed at its position for the abdominal muscle training exercise. At step ST62, the control device 112 determines whether the user 109 gets on the rectangular board 104 based on the detection signal received from the load sensor 118. If he or she gets on the rectangular board 104, the process goes to step ST63 where the control device 112 determines whether the user 109 has pulses more than a preset number thereof, for example, 100 pulses/minute, based on the detection signal of the pulse sensor 116. At step ST64, the control device 112 determines whether it has taken a predetermined period of time, for example, five minutes, while the user 109 has pulses more than a preset number thereof. If it has already taken the predetermined period of time, the process goes to step ST65.

It is to be noted that at the steps ST63, ST64, the control device 112 may determine whether the user 109 has body temperature more than a preset temperature thereof, which is similar to the steps ST43, ST44 in the flowchart shown in FIG. 5.

At the step ST65, the control device 112 controls the lifting-and-lowering mechanism 105 to decrease incline of the rectangular board 104 a little with the alert speaker 115 sounding an alert. This enables the user 109 to exercise the abdominal muscle training under the condition where any lord can be reduced by the decrease of the incline of the rectangular board 104. At step ST66, the control device 112 determines whether it has taken a predetermined period of time, for example, five minutes. If it has already taken the predetermined period of time, the process goes to step ST67 where the control device 112 controls the lifting-and-lowering mechanism 105 to lower the rectangular board 104 to its horizontal position.

At step ST68, the control device 112 controls the air-conditioning device 108 to blow cool air toward the user 109. At step ST69, the control device 112 determines whether it has taken a predetermined period of time, for example, ten minutes. If it has not yet taken the predetermined period of time, the process goes back to the step ST68 where the air-conditioning device 108 continues to blow the cool air toward the user 109. This prevents the user 109 from sweating even after the abdominal muscle training exercise. If it has already taken the predetermined period of time, the control device 112 controls the air-conditioning device 108 to stop blowing the cool air at step ST70. At step ST71, the process then stops.

According to this control operation, the incline of rectangular board 104 is automatically decreased when it has taken a predetermined period of time while the user 109 who exercises his or her abdominal muscle training on the rectangular board 104 has pulses more than a preset number of pulses or the temperature more than a preset body temperature thereof after the equipment 100 has been used as a fitness machine. Then, the rectangular board 104 is lowered to its horizontal position after a predetermined period of time, so that the equipment 100 can be used as a bed. This enables the user 109 to found a point of time when he or she stops exercising and reduces his or her abdominal muscle training. Further, this allows any operations of the user who lowers the rectangular board 104 from its position for the abdominal muscle training exercise to its horizontal position to be saved.

Further, the rectangular board 104 is lowered from its position for the abdominal muscle training exercise to its horizontal position so that the equipment 100 can be used as a bed. In this moment, the cool air is blown to the user 109 only for a predetermined period of time. This prevents the user 109 from sweating.

It is to be noted that default values of the predetermined periods of time at the steps ST6, ST11 in the flowchart shown in FIG. 3, at the steps ST24, ST27, ST30 in the flowchart shown in FIG. 4, at the steps ST44, ST47, ST51 in the flowchart shown in FIG. 5, and at the steps ST64, ST66, ST69 in the flowchart shown in FIG. 6 are initially used. Their learning values obtained by using them are then used. This enables any control using a period of time that is preferably suitable for the user to be implemented.

Figure 7:
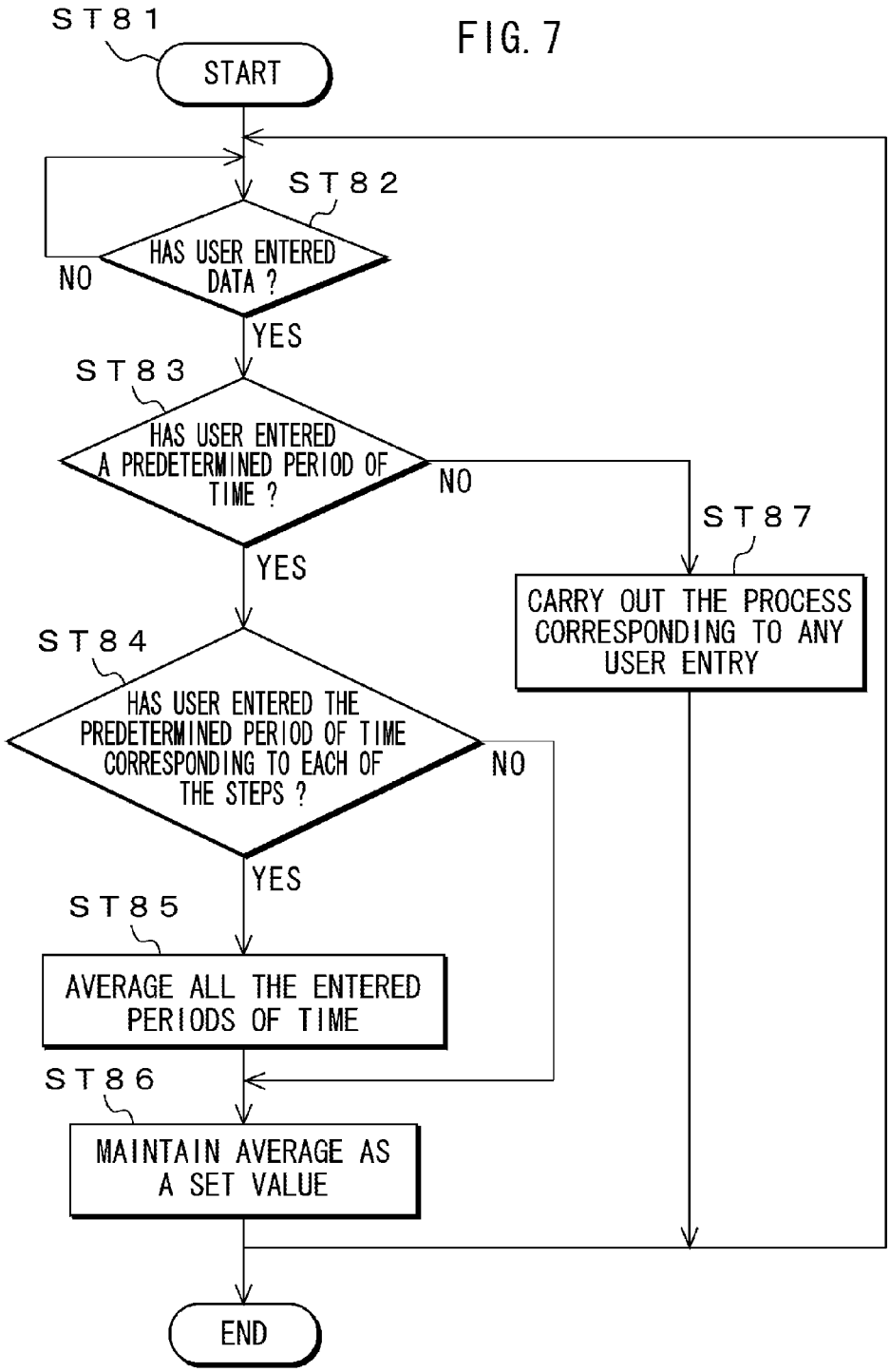
FIG. 7 is a flowchart for showing learning operations by the control device shown in FIG. 2.

FIG. 7 is a flowchart for showing learning operations of the control device 112.

At step ST81, the learning operation process thereof starts if, for example, the power is on. At step ST82, the control device 112 determines whether a user enters data by using the keyboard 113. If he or she enters the data, the process goes to step ST83 where the control device 112 determines whether the user enters a predetermined period of time corresponding to each of the above steps. If he or she enters the predetermined period of time corresponding to each of the above steps, the process goes to step ST84 where the control device 112 determines whether the user has already entered the predetermined period of time corresponding to each of the above steps. If he or she has already entered the predetermined period of time corresponding to each of the above steps, the process goes to step ST85 where all the entered periods of time are averaged or the entered periods of time by previous numbers of times, for example, previous 10 times, are averaged. At step ST86, the control device 112 controls the RAM 123 to maintain this average as a set value of the predetermined period of time corresponding to each of the above steps. The process then goes back to the step ST82 where the process waits next user entry.

If the user has not yet entered the predetermined period of time corresponding to each of the above steps at the step ST84, the process goes directly to step ST86 where the control device 112 controls the RAM 123 to maintain this predetermined period of time corresponding to each of the above steps, which has been entered at the step ST83, as a set value of the predetermined period of time corresponding to each of the above steps. The process then goes back to the step ST82.

If the user entered anything other than the predetermined period of time at the step ST83, the process goes to step ST87 where any operation is carried out corresponding the entry and then, goes back to the step ST82.

Although the equipment 100 used as a bed and a fitness machine has described so that the base 101 mounts the mattress-supporting plate 102, the rectangular board 104 for abdominal muscle training exercise, and the like, as shown in FIG. 1, a unit including the mattress-supporting plate 102, the rectangular board 104 and the like, which excludes the base 101, can be settled on a bottom of a bathtub, which is not shown. This enables the user to exercise the abdominal muscle training with him or her taking a bath. In this case, water in the bathtub allows heavier training load to be applied to the user by means of resistance of the water.

Figure 8:
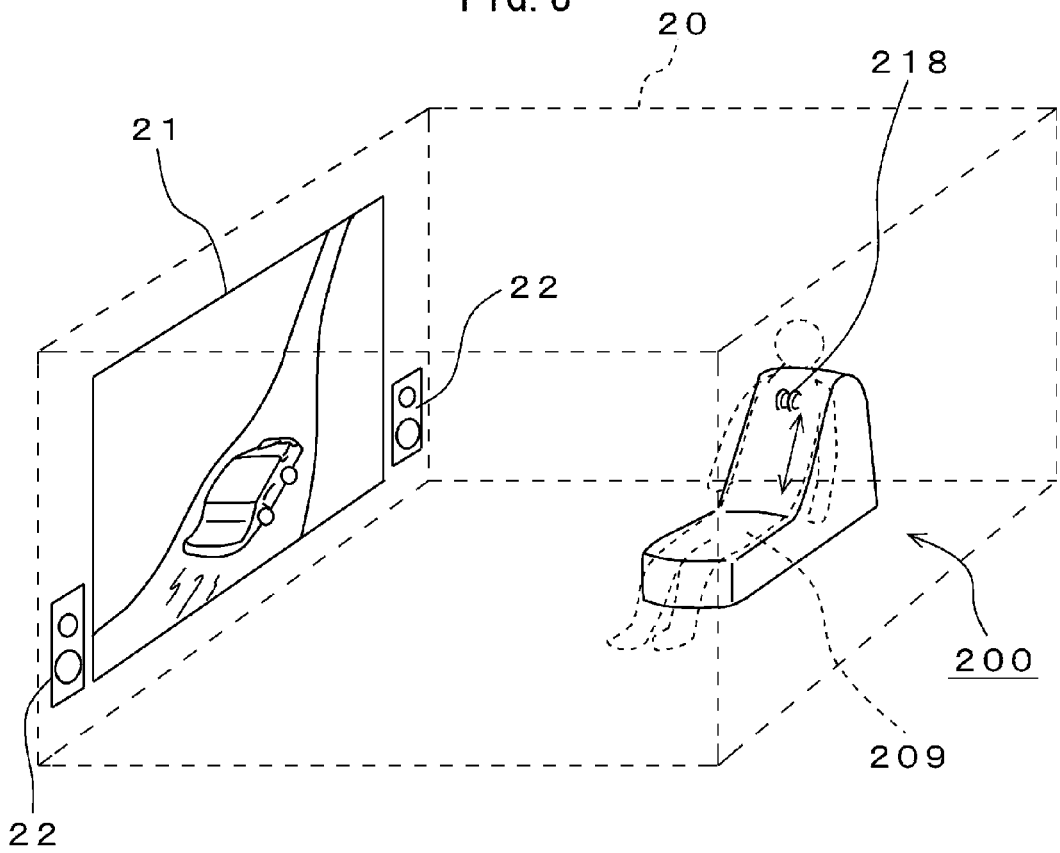
FIG. 8 is a diagram for illustrating an outline configuration of a multifunction chair according to a second embodiment of the invention.

FIG. 8 illustrates an outline configuration of a multifunction chair 200 according to a second embodiment of the invention.

The multifunction chair 200 constitutes a room 20. Image display device 21 and audio output device 22 are installed on, for example, a wall of the room 20. The image display device 21 is constituted of a projector of rear-projection type, a screen of which is filled in a space of the wall. The audio output device 22 is constituted of right and left speakers filled in the holes of the wall.

An outer surface of the multifunction chair 200 is formed so that any pressure is applied to a floor of the room 20 upwardly. The outer surface of the multifunction chair 200 is continuous to the floor. The multifunction chair 200 has a massage operation portion, as a first pressuring device, for pressuring a predetermined position of a region of the chair contacting human body of a user 209 by massage heads 218 to provide the user 209 with any massage effects. The multifunction chair 200 also has a chair-driving portion, as a second pressuring device, for pressuring a selected region of the region contacting the human body of the user 209 to provide the user 209 with the movement corresponding to any motion in the image display device 21. It is to be noted that the selected region is the entire region contacting the human body of the user 209, a backrest region or a seat region.

Figure 9:
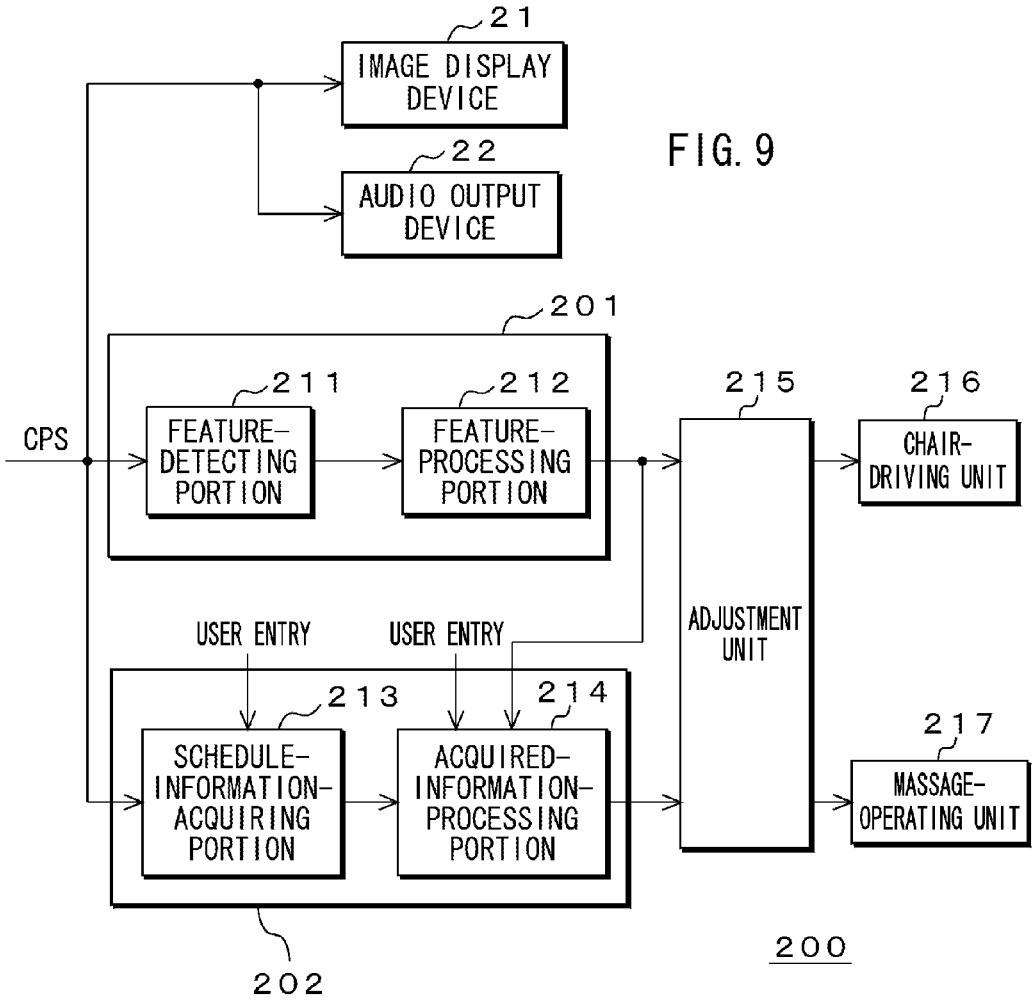
FIG. 9 is a block diagram for illustrating a configuration of the multifunction chair shown in FIG. 8.

FIG. 9 illustrates a configuration of the multifunction chair 200. The multifunction chair 200 has a motion-control-signal-processing unit 201, a massage-signal-processing unit 202, an adjustment unit 215, a chair-driving unit 216, and a massage-operating unit 217.

The motion-control-signal-processing unit 201 includes a feature-detecting portion 211 and a feature-processing portion 212. The motion-control-signal-processing unit 201 receives a contents-playback signal CPS. The feature-detecting portion 211 receives the contents-playback signal CPS and detects motion vector for each frame from an image signal included in the contents-playback signal CPS. The feature-detecting portion 211 also calculates from the motion vector a horizontal component u, a vertical component v, a zoom component Vzoom, a rotation component Vrot of the motion. The feature-processing portion 212 generates a motion-control-signal component, pitch, for representing an incline of road in traveling way, a motion-control-signal component, z, for representing vibration generated by the road, a motion-control-signal component, roll, for representing an incline of road from side to side, and the like by using the components calculated in the feature-detecting portion 211. Such the motion-control-signal-processing unit 201 has been described in Japanese Patent Applications No. JP 2000-214755, the entire contents of which being incorporated herein by reference.

The massage-signal-processing unit 202 includes a schedule-information-acquiring portion 213 and an acquired-information-processing portion 214. The massage-signal-processing unit 202 also receives the contents-playback signal CPS.

The schedule-information-acquiring portion 213 receives the contents-playback signal CPS and acquires therefrom information for generating a massage program such as information on a total amount of contents-playback time, a period of massage time, division frequency in one massage time. The schedule-information-acquiring portion 213 then transmits them to the following acquired-information-processing portion 214.

Figure 10:
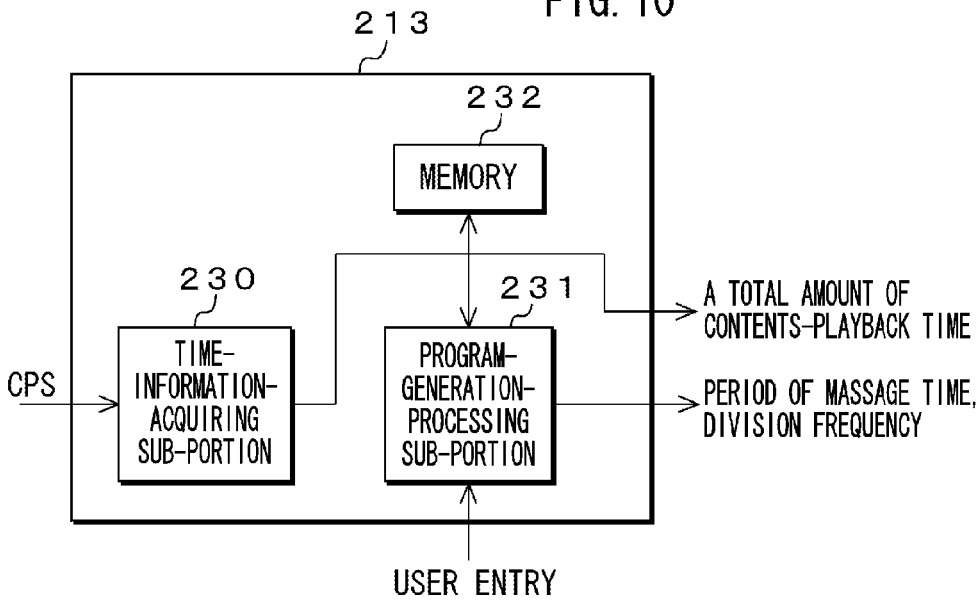
FIG. 10 is a block diagram for illustrating a detailed configuration of a schedule-information-acquiring portion.

FIG. 10 illustrates a detailed configuration of the schedule-information-acquiring portion 213. The schedule-information-acquiring portion 213 includes a time-information-acquiring sub-portion 230, a program-generation-processing sub-portion 231, and a memory 232.

TABLE 1

| MODES | PERIODS OF MASSAGE TIME | DIVISION FREQUENCY |
|---|---|---|
| 1 | 30 | 10 |
| 2 | 20 | 1 |
| : | : | : |

The time-information-acquiring sub-portion 230 receives the contents-playback signal CPS. The time-information-acquiring sub-portion 230 acquires, for example, a total amount of contents-playback time from the received contents-playback signal CPS. The memory 232 stores a following table, TABLE 1, including modes, periods of massage time, and division frequencies.

The program-generation-processing sub-portion 231 receives from an outside entry device a user entry for selecting the mode. The program-generation-processing sub-portion 231 acquires the period of massage time and the division frequency, which correspond to the selected mode, referring to the table stored the memory 232. The schedule-information-acquiring portion 213 transmits the total amount of contents-playback time, which has been acquired in the time-information-acquiring sub-portion 230, and the period of massage time and the division frequency, which have been acquired in the program-generation-processing sub-portion 231.

The acquired-information-processing portion 214 generates a massage-operating signal for operating the massage-operating unit 217 based on pieces of the information acquired in the schedule-information-acquiring portion 213.

Figure 11:
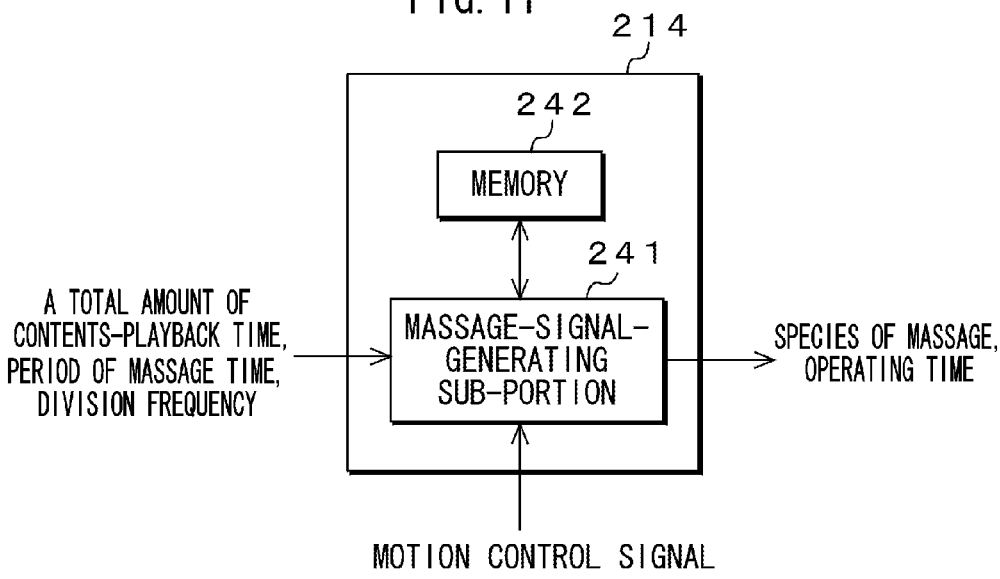
FIG. 11 is a block diagram for illustrating a detailed configuration of an acquired-information-processing portion.

FIG. 11 illustrates a detailed configuration of the acquired-information-processing portion 214. The acquired-information-processing portion 214 includes a massage-signal-generating sub-portion 241 and a memory 242. The memory 242 stores a following table, TABLE 2, including species of massages, operating time, and strength level.

TABLE 2

| SPECIES OF MASSAGES | OPERATING TIME | STRENGTH LEVEL |
|---|---|---|
| TAPPING | 5 | 3 |
| KNEADING/ROLLING | 4 | 2.5 |
| STRETCHING | 4.5 | 1.5 |
| : | : | : |

The massage-signal-generating sub-portion 241 receives the total amount of contents-playback time, the period of massage time and the division frequency from the schedule-information-acquiring portion 213. The massage-signal-generating sub-portion 241 also receives the motion control signal (for example, motion-control-signal component, z, for representing vibration generated by the road) calculated in the feature-processing portion 212.

The massage-signal-generating sub-portion 241 sets a threshold value adaptively altering with the passage of time based on the total amount of contents-playback time and the division frequency. The massage-signal-generating sub-portion 241 then acquires a species of the massage and its operating time referring to the table, TABLE 2, stored in the memory 242, based on the threshold value, an amount of the motion control signal, and a period of massage time and generates a massage-operating signal corresponding to them.

In this embodiment, a massage is basically carried out during a period of time when an amount of the motion control signal is more than the threshold value. If the period of time when an amount of the motion control signal is more than the threshold value is short, no period of time for massage to be performed can be achieved. Contrarily, if the period of time when an amount of the motion control signal is more than the threshold value is long, a period of time for massage to be performed can be early achieved. Thus, a species of massage and its operating time are selected so that it is possible to achieve the period of time for massage to be performed.

It is to be noted that the threshold value is first set to a little one against the contents, gradually to an increased one, finally to a little one. The table, TABLE 2, can include any information on which period of contents (for example, its opening stage, its middle stage or its final stage) the massage is preferably carried out and thus, the species of massage and its operating time can be selected referring to that.

The adjustment unit 215 receives the massage-operating signal from the massage-signal-processing unit 202 and transmits it to the massage-operating unit 217. The adjustment unit 215 also receives the motion control signal from the motion-control-signal-processing unit 201 and transmits it to the chair-driving unit 216 when no massage is carried out.

The chair-driving unit 216 and the massage-operating unit 217 respectively perform any moving operation on the entire chair and any massage operation to the user based on the motion control signal and the massage-operating signal received from the adjustment unit 215.

The following will describe operations of the multifunction chair 200 shown in FIG. 9.

The contents-playback signal CPS is supplied to the motion-control-signal-processing unit 201. The feature-detecting portion 211 detects motion vector for each frame from an image signal included in the contents-playback signal CPS. The feature-detecting portion 211 also calculates from the motion vector a horizontal component u, a vertical component v, a zoom component Vzoom, a rotation component Vrot of the motion. These components of motion are supplied to the feature-processing portion 212. The feature-processing portion 212 generates a motion control signal for moving the entire chair using these components of the motion.

The contents-playback signal CPS is also supplied to the massage-signal-processing unit 202. The schedule-information-acquiring portion 213 acquires the total amount of contents-playback time from the contents-playback signal CPS and acquires the period of massage time and the division frequency from the table, TABLE 1, based on the mode selection by the user. The information on the total amount of contents-playback time, the period of massage time, and the division frequency is supplied to the acquired-information-processing portion 214.

The acquired-information-processing portion 214 acquires a species of massage and its operating time sequentially from the table, TABLE 2, based on the total amount of contents-playback time, the period of massage time, and the division frequency as well as the motion control signal calculated in the feature-processing portion 212. The acquired-information-processing portion 214 then generates a massage-operating signal corresponding to them.

The massage-operating signal transmitted from the massage-signal-processing unit 202 is supplied to the massage-operating unit 217 through the adjustment unit 215. This enables the massage-operating unit 217 to perform any massage on the user. In this case, the movable massage heads (see FIG. 8) built in the backrest of the multifunction chair 200 pressures predetermined portions of the human body.

The motion control signal transmitted from the motion-control-signal-processing unit 201 is supplied to the chair-driving unit 216 through the adjustment unit 215 when no massage is carried out. This enables the entire multifunction chair 200 to provide the human body with any movement of the chair 200 according to the motion control signal. This movement is traveled to the human body. This allows the user to feel much sensitively as if he or she were there.

The contents-playback signal CPS is further supplied to the image display device 21. The image display device 21 displays an image based on the image signal included in the contents-playback signal CPS. The contents-playback signal CPS is also supplied to the audio output device 22. The audio output device 22 outputs audio based on the audio signal included in the contents-playback signal CPS.

Thus, according to the multifunction chair 200 shown in FIGS. 8 and 9, any massage effects and any movement of the chair for allowing the audience to feel as if he or she were there much sensitively are given his or her human body according to the feature, for example, an amount of the motion control signal, extracted from the contents-playback signal. Thus, the multifunction chair 200 can give the human body not only feeling as if he or she were there but also massage effects so that the movement of the chair allows the human body to be less tired by the massage effects. Such the less tired human body can further feel as if he or she were there much excitedly by the movement.

In this case, if the entire chair is moved based on the motion control signal, the movement of the chair is traveled to a predetermined portion of the human body through the massage heads 218. This can give the user not only any feeling as if he or she were there but also any massage effects.

It is to be noted that, in the multifunction chair 200 shown in FIG. 9, the table, TABLE 2, can be customized by the followings: user entry such as strength of the massage, a species of the massage, and its operation time, from outside can be adjusted; any information on them can be supplied to the acquired-information-processing portion 214 and stored in the memory 242 thereof, and any learning can be performed based on the information.

Although, in the multifunction chair 200, it has been described that a massage is performed for a period of time when an amount of the motion control signal is more than a threshold value, the invention is not limited to this. It is possible to perform a massage for a period of time when an amount of the motion control signal is less than a threshold value. Alternatively, if two threshold values having a predetermined interval are set, it is possible to perform a massage when an amount of the motion control signal stays within a region between the two threshold values or without the region.

Figure 12:
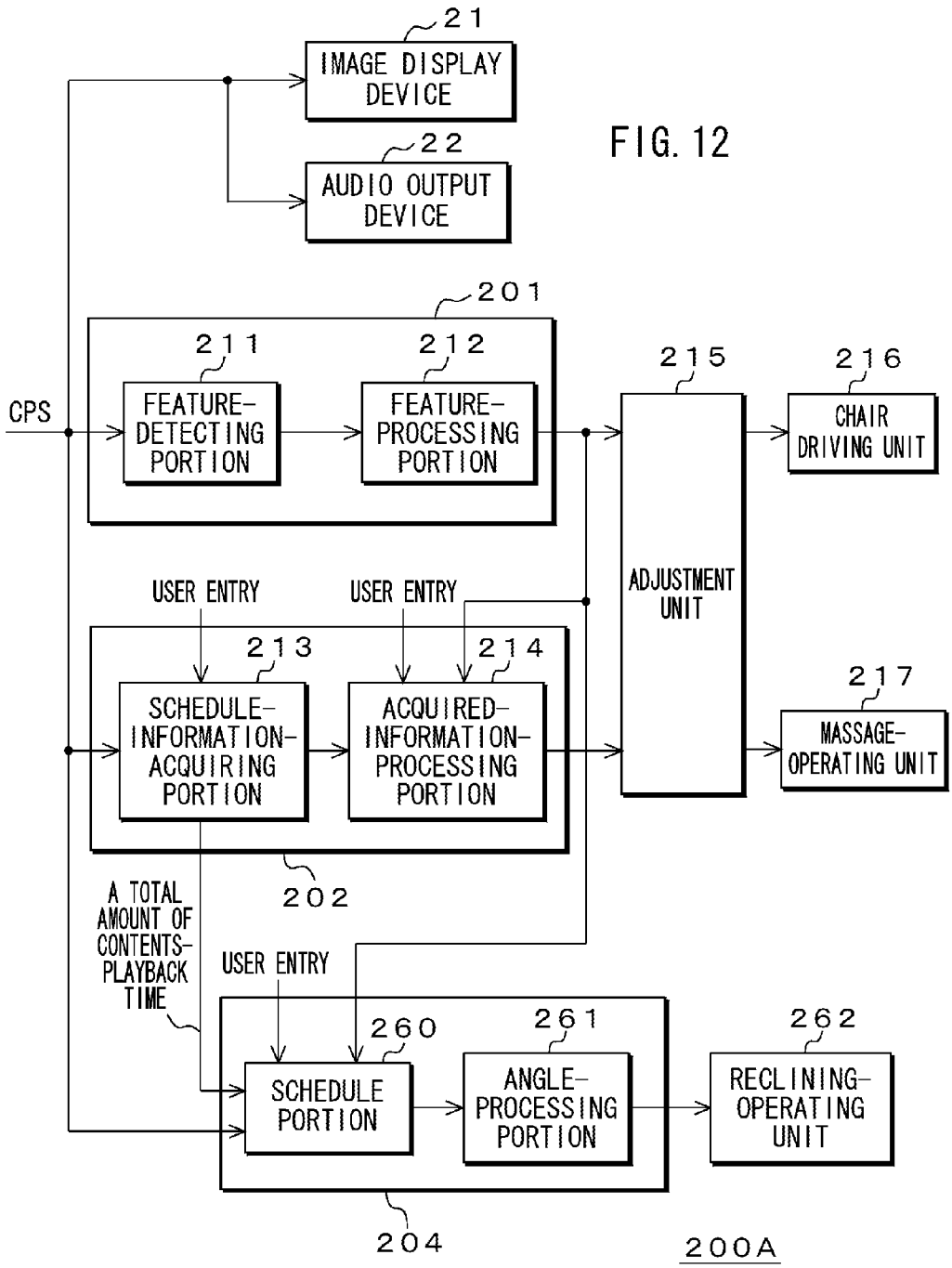
FIG. 12 is a block diagram for illustrating a configuration of a multifunction chair according to a third embodiment of the invention.

Next, FIG. 12 illustrates a configuration of a multifunction chair 200A according to a third embodiment of the invention. In FIG. 12, like reference characters refer to like elements shown in FIG. 9, detailed explanation of which will be omitted.

The multifunction chair 200A has a motion-control-signal-processing unit 201, a massage-signal-processing unit 202, a reclining-processing unit 204, an adjustment unit 215, a chair-driving unit 216, a massage-operating unit 217, and a reclining-operating unit 262.

These motion-control-signal-processing unit 201, massage-signal-processing unit 202, adjustment unit 215, chair-driving unit 216, and massage-operating unit 217 are similar to these of the multifunction chair 200 shown in FIG. 9 and thus, detailed explain of them will be omitted.

The reclining-processing unit 204 includes a schedule portion 260 and an angle-processing portion 261. The schedule portion 260 receives information on a total amount of contents-playback time acquired in the schedule-information-acquiring portion 213 of the massage-signal-processing unit 202, and a motion control signal generated in the feature-processing portion 212 of the motion-control-signal-processing unit 201. The schedule portion 260 also receives the contents-playback signal CPS.

The schedule portion 260 compares a feature of the audio signal included in the contents-playback signal CPS and a feature of the motion control signal with a predetermined threshold based on the information on the total amount of contents-playback time. For example, relative to the audio signal, the feature is such that a ratio of time for playing music is increased and relative to the motion control signal, the feature is such that the movement of the chair is decreased. Based on the comparison, a time schedule for reclining process can be laid out. The angle-processing portion 261 generates a reclining-processing signal for reclining slowly according to the time schedule laid out in the schedule portion 260.

Figure 13A:
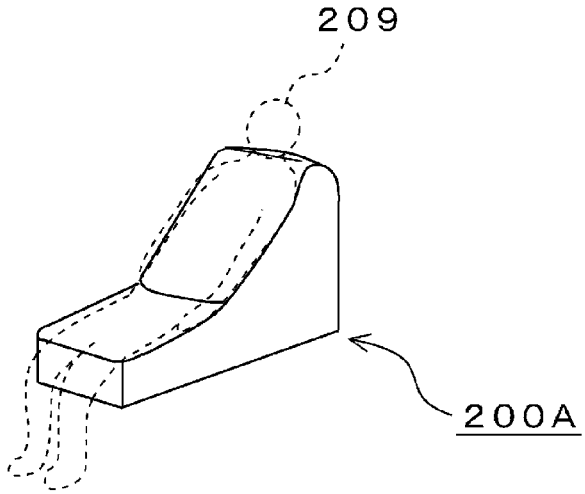
FIGS. 13A through 13C are diagrams each for illustrating an example of a change in the shape of chair by reclining.
Figure 13B:
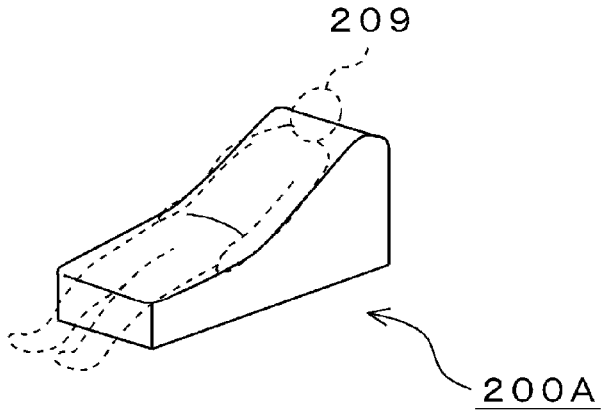
Figure 13C:
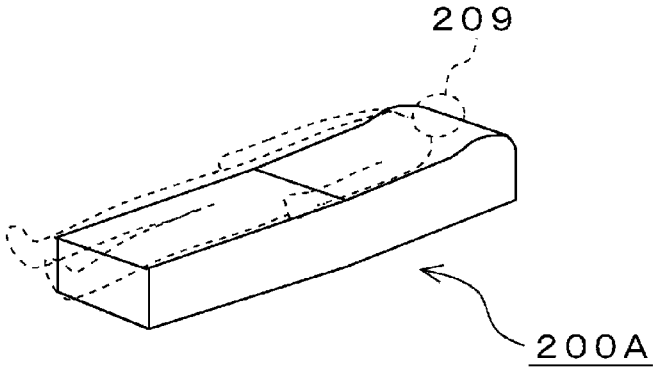

The reclining-operating unit 262 reclines the backrest of the multifunction chair 200A slowly as shown in FIGS. 13A through 13C based on the reclining-processing signal generated in the angle-processing portion 261 of the reclining-processing unit 204. In this case, the reclining-operating unit 262 alters a pressure applied to the floor gradually so that outer surface of the multifunction chair 200A that is continuous with the floor can alter. The reclining-operating unit 262 is constituted as a third pressuring device. It is to be noted that as shown in FIGS. 13A through 13C, a seat and the backrest are extended while the backrest is reclined. This allows an entire body of the user 209 to be mounted on the multifunction chair 200A finally.

The following will describe operations of the multifunction chair 200A shown in FIG. 12.

The contents-playback signal CPS is supplied to the schedule portion 260 of the reclining-processing unit 204. The information on the total amount of contents-playback time from the massage-signal-processing unit 202, and the motion control signal from the motion-control-signal-processing unit 201 are also supplied to the schedule portion 260. The schedule portion 260 lays out a time schedule for the reclining operation based on the information on the total amount of contents-playback time referring to the feature in the audio signal included in the contents-playback signal CPS and the feature in the motion control signal.

The time schedule is supplied to the angle-processing portion 261. The angle-processing portion 261 generates a reclining-processing signal for reclining slowly according to the time schedule thus laid out. The reclining-processing signal is supplied to the reclining-operating unit 262. The reclining-operating unit 262 reclines a backrest of the multifunction chair 200A slowly to alter its shape slowly.

Other operations of the multifunction chair 200A are similar to those of the multifunction chair 200 shown in FIG. 9.

According to this multifunction chair 200A, any excellent effects same as those of the multifunction chair 200 shown in FIG. 9 can be obtained. Further, when the contents are moving pictures, the multifunction chair 200A can make the user drowsy comfortably after seeing a moving picture. Namely, the multifunction chair 200A moves during an early portion of the moving picture similar to the usual but it can be switched from moving to reclining slowly according to the feature in the audio signal included in the contents-playback signal CPS and the feature in the motion control signal.

It is to be noted that, in the multifunction chair 200A shown in FIG. 12, a memory, which is not shown, of the schedule portion 260 can store any other user entry from outside, for example, much earlier switch or much later switch is desired. According to the user entry from outside, the threshold value when the time schedule is laid out can be changed.

Figure 14:
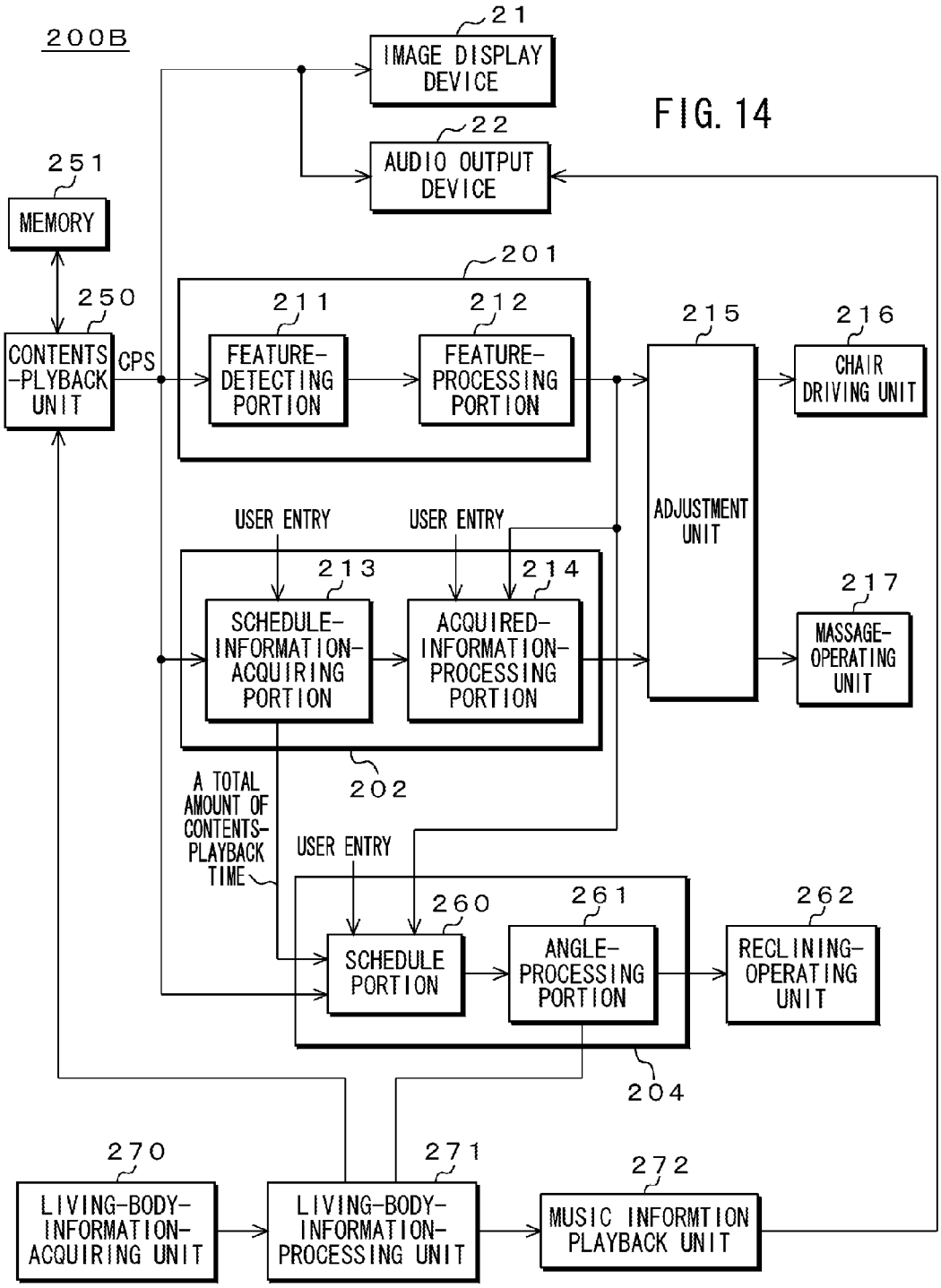
FIG. 14 is a block diagram for illustrating a configuration of a multifunction chair according to a fourth embodiment of the invention.

FIG. 14 illustrates a configuration of a multifunction chair 200B according to a fourth embodiment of the invention. In FIG. 14, like reference characters refer to like elements shown in FIG. 12, detailed explanation of which will be omitted.

A contents-playback unit 250 reproduces the contents-playback signal CPS. This multifunction chair 200B has a living-body-information-acquiring unit 270, a living-body-information-processing unit 271, and a music-information-playback unit 272 in addition to the units of the multifunction chair 200A shown in FIG. 12.

The living-body-information-acquiring unit 270 measures a wave of the user 209 who sits on the multifunction chair 200B (see FIG. 8).

The living-body-information-processing unit 271 determines whether the user has slept based on his or her a wave measured by the living-body-information-acquiring unit 270. If it is determined that the user has slept, the living-body-information-processing unit 271 issues a playback-stopping signal to the contents-playback unit 250. The contents-playback unit 250 stores playback position information on a playback stop position thereof in a memory 251 when the contents-playback unit 250 stops the playback of contents by the playback-stopping signal.

If it is determined that the user has slept, the living-body-information-processing unit 271 also issues a playback-starting signal to the music-information-playback unit 272. The music-information-playback unit 272 reproduces an audio signal relative to any comfortable ambient sound based on the playback-starting signal and supplies the audio signal to the audio output device 22.

If it is determined that the user has slept, the living-body-information-processing unit 271 further issues a reclining signal to the angle-processing portion 261 of the reclining-processing unit 204. The angle-processing portion 261 supplies to the reclining-operating unit 262 a processing signal for allowing the reclining-operating unit 262 to recline the backrest of the multifunction chair 200B to its most reclined state (see FIG. 13C) based on the reclining signal.

The living-body-information-processing unit 271 additionally determines whether the user has awoken from his or her sleep. If it is determined he or she has awoken, the living-body-information-processing unit 271 issues a playback-restarting signal to the contents-playback unit 250. The contents-playback unit 250 restarts the playback from the playback stop position thereof referring to the information on playback stop position stored in the memory 251 based on the playback-restarting signal.

If it is determined he or she has awoken, the living-body-information-processing unit 271 also issues a playback-stopping signal to the music information playback unit 272. The music information playback unit 272 stops the playback of the audio signal based on the playback-stopping signal.

If it is determined he or she has awoken, the living-body-information-processing unit 271 further issues to the angle-processing portion 261 of the reclining-processing unit 204 a command signal for allowing the reclining-operating unit 262 to return the backrest of the multifunction chair 200B to its original state (see FIG. 13A). The angle-processing portion 261 transmits to the reclining-operating unit 262 a processing signal for allowing the reclining-operating unit 262 to return the backrest of the multifunction chair 200B to its original state (see FIG. 13A) based on the command signal.

The following will describe operations of the multifunction chair 200B shown in FIG. 14.

The living-body-information-acquiring unit 270 measures $\alpha$ wave of the user 209 who sits on the multifunction chair 200B. This $\alpha$ wave is supplied to the living-body-information-processing unit 271. The living-body-information-processing unit 271 determines whether the user has slept or whether the user has awoken from his or her sleep, based on his or her $\alpha$ wave.

If it is determined that the user has slept, the living-body-information-processing unit 271 issues the playback-stopping signal to the contents-playback unit 250. The contents-playback unit 250 stops the playback of contents based on the playback-stopping signal. In this moment, the contents-playback unit 250 stores the playback position information on a playback stop position thereof in the memory 251.

If it is determined that the user has slept, the living-body-information-processing unit 271 also issues the playback-starting signal to the music-information-playback unit 272. The music-information-playback unit 272 reproduces an audio signal relative to any comfortable ambient sound based on the playback-starting signal and supplies the audio signal to the audio output device 22. This enables the audio output device 22 to output any comfortable ambient sound, thereby allowing the user to be much comfortably slept.

If it is determined that the user has slept, the living-body-information-processing unit 271 further issues the reclining signal to the angle-processing portion 261 of the reclining-processing unit 204. The angle-processing portion 261 issues a processing signal for allowing the reclining-operating unit 262 to recline the backrest of the multifunction chair 200B to its most reclined state (see FIG. 13C) based on the reclining signal and supplies the processing signal to the reclining-operating unit 262. This most reclined state of the backrest of the multifunction chair 200B allows the user to be comfortably slept.

If it is determined he or she has awoken, the living-body-information-processing unit 271 issues the playback-restarting signal to the contents-playback unit 250. The contents-playback unit 250 restarts the playback from the playback stop position thereof referring to the information on playback stop position stored in the memory 251 based on the playback-restarting signal. This allows the user to see and/or listen to image and/or audio of the contents following the playback stop position thereof where the user has slept.

If it is determined he or she has awoken, the living-body-information-processing unit 271 also issues the playback-stopping signal to the music information playback unit 272. The music information playback unit 272 stops the playback of the audio signal based on the playback-stopping signal.

If it is determined he or she has awoken, the living-body-information-processing unit 271 further issues to the angle-processing portion 261 of the reclining-processing unit 204 a command signal for allowing the reclining-operating unit 262 to return the backrest of the multifunction chair 200B to its original state. The angle-processing portion 261 transmits to the reclining-operating unit 262 the processing signal for allowing the reclining-operating unit 262 to return the backrest of the multifunction chair 200B to its original state (see FIG. 13A) based on the command signal. This returned (raised) state of the backrest of the multifunction chair 200B allows the user to see any image of the contents advantageously.

Other operations of the multifunction chair 200B are similar to those of the multifunction chair 200A shown in FIG. 12.

According to this multifunction chair 200B, any excellent effects same as those of the multifunction chair 200A shown in FIG. 12 can be obtained. Further, based on the α wave as a living body signal acquired from the human body of the user, the multifunction chair 200B can alter its shape automatically when the user has slept and awoken from his or her sleep. This allows any change of the angle of the backrest by the user to be saved.

Although, in the multifunction chair 200B shown in FIG. 14, the αwave has been described as a living body signal, this invention is not limited thereto. Other living body signal such as body temperature, pulses or the like can be detected and an angle of the backrest of the multifunction chair 200B can be automatically changed based on the detected living body signal fitting any condition of the user.

Further, if it is determined the user is in a drowse based on his or her α wave, the living-body-information-processing unit 271 can transmit a signal for decreasing a massage strength level to the acquired-information-processing portion 214 of the massage-signal-processing unit 202 and a signal for decreasing a strength of its movement of the chair to the feature-processing portion 212 of the motion-control-signal-processing unit 201. This has not been shown.

The embodiments of the invention are preferably applied to equipment used as a bed and a fitness machine, and a chair for audience (an audience seat) that gives the human body not only any feeling as if he or she were there concerning the contents but also massage effects.

It should be understood by those skilled in the art that various modifications, combinations, sub-combinations and alternations may occur depending on design requirements and other factors insofar as they are within the scope of the appended claims or the equivalents thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. Multifunction equipment that is installed in a room, the equipment comprising:

a main body;

movable means for moving to implement a plurality of functions, thereby allowing the multifunction equipment to be used as a plurality of functional devices, said movable means being connected to the main body;

assisting means for assisting a use of the multifunction equipment as a desired functional device;

user-condition-detecting means for detecting a user condition of a user who uses the multifunction equipment; and moving control means for controlling a position of the movable means based on the detected user condition.

2. The multifunction equipment according to claim 1 wherein the multifunction equipment includes equipment used as a bed and a fitness machine;

wherein the assisting means for assisting a use of the multifunction equipment as the fitness machine includes at least one of a shower device and a cooler device; and wherein the assisting means for assisting a use of the multifunction equipment as the bed includes an air-conditioning device.

3. The multifunction equipment according to claim 1 further comprising:

adjusting means for adjusting an assisting condition of the assisting means based on the detected user condition.

4. The multifunction equipment according to claim 1 further comprising:

room-condition-detecting means for detecting a condition in the room; and adjusting means for adjusting an assisting condition of the assisting means based on a detected result by the room-condition-detecting means.

5. The multifunction equipment according to claim 1, wherein the moveable means is comprised of a board with an attached sit-up bar.

6. Multifunction equipment that is installed in a room, the equipment comprising:

main body;

movable device that moves to implement a plurality of functions, thereby allowing the multifunction equipment to be used as a plurality of functional devices, said movable device being connected to the main body;

assisting device that assists a use of the multifunction equipment as a desired functional device;

user-condition-detecting device that detects a user condition of a user who uses the multifunction equipment; and moving control device that controls a position of the movable means based on the detected user condition.

* * * * *